US007241177B1

(12) United States Patent
Lai

(10) Patent No.: US 7,241,177 B1
(45) Date of Patent: Jul. 10, 2007

(54) TERMINAL-PROTECTIVE CARD CONNECTOR

(75) Inventor: Yaw-Huey Lai, Taipei County (TW)

(73) Assignee: Tai-Sol Electronics Co., Ltd., Taipei (TW)

( * ) Notice: Subject to any disclaimer, the term of this patent is extended or adjusted under 35 U.S.C. 154(b) by 0 days.

(21) Appl. No.: 11/634,190

(22) Filed: Dec. 6, 2006

(30) Foreign Application Priority Data

Jul. 13, 2006 (TW) ..... 95212315 U

(51) Int. Cl.
*H01R 24/00* (2006.01)

(52) U.S. Cl. ..... 439/635

(58) Field of Classification Search ..... 439/630, 439/635, 634, 260
See application file for complete search history.

(56) References Cited

U.S. PATENT DOCUMENTS 6,699,053 B2 * 3/2004 Kuroda ..... 439/218
7,059,912 B2 * 6/2006 Tsai ..... 439/630
7,153,165 B2 * 12/2006 Lai et al. ..... 439/630
7,182,645 B2 * 2/2007 Shimizu et al. ..... 439/630

FOREIGN PATENT DOCUMENTS

CN 200320103938.3 12/2004

* cited by examiner

*Primary Examiner*—Phuong Dinh
(74) *Attorney, Agent, or Firm*—Bacon & Thomas, PLLC

(57) ABSTRACT

A terminal-protective card connector composed of a housing including a base having a rear sidewall, a left sidewall, a right sidewall, and a rear platform; a group of first terminals and a group of second terminals, each of which includes a root portion and a contact portion, the root portions of the first and second terminals being fixedly inserted above and below the rear platform respectively, each of the left and right sidewalls having a slide groove; and a pivoting device pivotably mounted between the left and right sidewalls and having a plate member having a plurality of pushing portions, a left plate located, a right plate, and two slide channels corresponding to the slide grooves respectively. The contact portions of the second terminals are mounted on a top surface of the plate member. The second terminals lie on the pushing portions to enable the contact portions of the second terminals to be lower than the rear platform.

9 Claims, 10 Drawing Sheets

TERMINAL-PROTECTIVE CARD CONNECTOR

BACKGROUND OF THE INVENTION

1. Field of the Invention

The present invention relates generally to card connectors, and more particularly, to a terminal-protective card connector.

2. Description of the Related Art

In the design of the conventional all-in-one card connector, when an electronic card is inserted for electrical connection with the terminals located at the innermost of the card connector, the card passes through the terminals located close to the entrance of the card connector to contact and squeeze them and may accordingly twist and deform them to affect the access to the data in the card. Further, the twisted and deformed terminals are much subject to greater deformation resulted from the impingement of other cards and the worst, may malfunction to affect the use of the cards and the terminals located close to the entrance of the card connector.

As disclosed in China Patent Application No. 200320103938.3, a card connector includes a base and a frame. The base has numerous groups of terminals mounted therein. The frame is slidably mounted in the base for receiving a variety of cards. The terminals of each group have contact portions extending into the base for corresponding contact with the electrical contacts of the cards. The frame can accurately position the card and then slidably accommodate the card in the base to enable more smooth and secure electric connection between the card and the terminals. However, the frame tends to impinge and then damage the terminals very much, during the slidable movement, to further affect the access to the card.

SUMMARY OF THE INVENTION

The primary objective of the present invention is to provide a terminal-protective card connector, which can protect the terminals from malfunction resulted from twist and deformation incurred by impingement of an inserted card.

The foregoing objective of the present invention is attained by the terminal-protective card connector composed of a housing, a group of first terminals, a group of second terminals, and a pivoting device. The housing includes a base having a rear sidewall, a left sidewall, a right sidewall, and a rear platform protruding forward from a midsection of the rear sidewall. Each of the first and second terminals includes a root portion and a contact portion. The root portions of the first and second terminals are fixedly inserted above and below the rear platform respectively. Each of the left and right sidewalls has a slide groove formed at an inner side thereof. The pivoting device is pivotably mounted between the left and right sidewalls, having a plate member. The plate member includes a plurality of pushing portions located thereon, a left plate located at a left fringe thereof, a right plate located at a right fringe thereof, and two slide channels formed at inner sides of the left and right plates and corresponding to the slide grooves of the left and right sidewalls respectively. The contact portions of the second terminals are mounted on a top surface of the plate member. The second terminals lie on the pushing portions to enable the contact portions of the second terminals to be lower than the rear platform.

The effects of the present invention are recited as follows. The base includes the slide grooves formed at two sides thereof and the pivoting device mounted therein, and the pivoting device includes the slide channels, such that while a short and wide secure digital (SD) card is inserted, the SD card passes through the slide grooves and channels to pull the pivoting device upward, and thus, the contact portions of the second terminals touch contact pins of the SD card for electrical conduction therebetween; while a long and narrow memory stick (MS) card is inserted, the MS card passes over the second terminals and then electrically contacts the first terminals for electrical conduction without contact with the second terminals. In light of this, the present invention achieves that one card connector can receive multiple kinds of cards and effectively prevent each inserted card (MS card) corresponding to the first terminals from crashing into the second terminals to keep the terminals of the card connector safe.

DETAILED DESCRIPTION OF PREFERRED EMBODIMENTS

Figure 1:
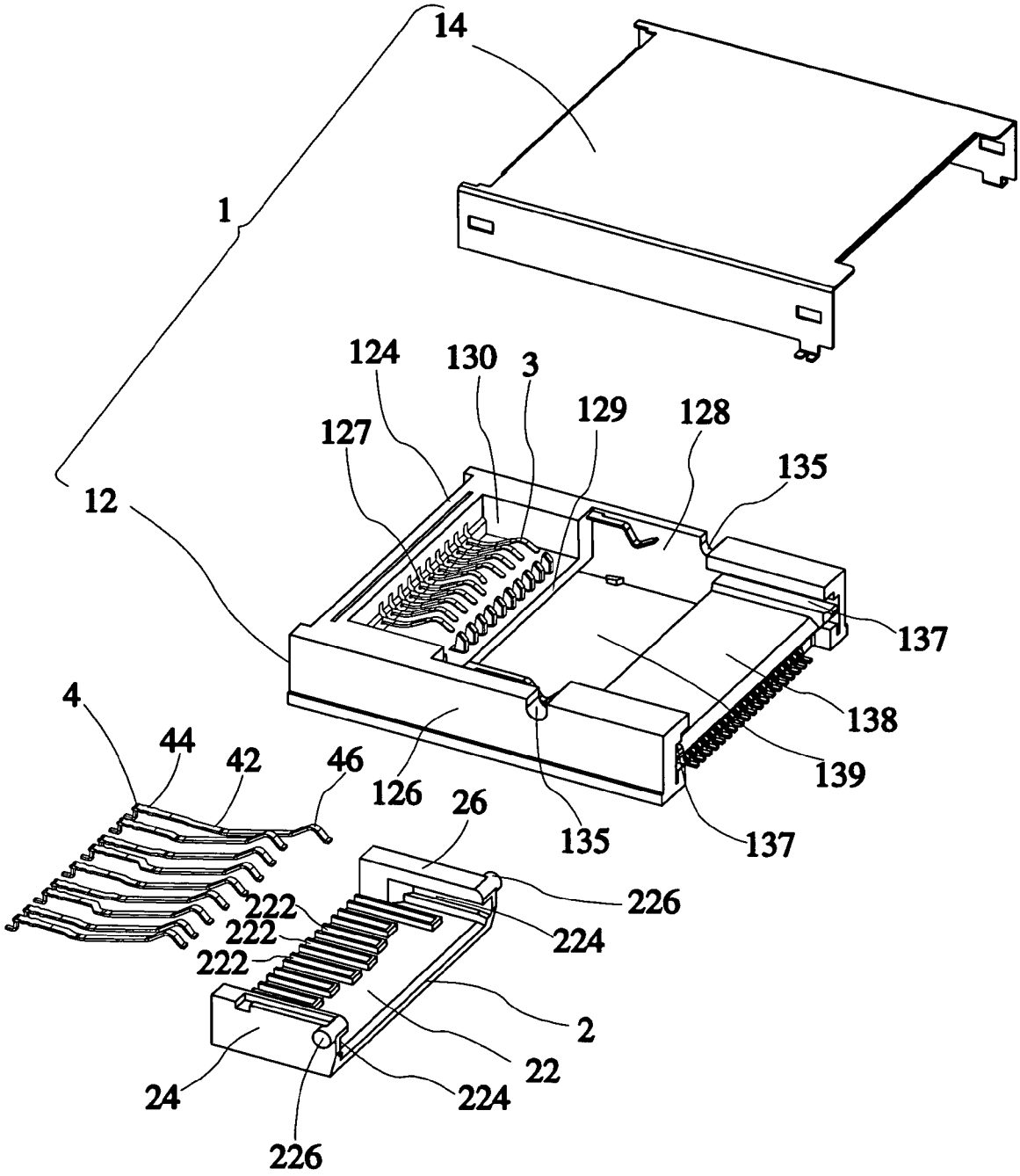
FIG. 1 is a perspective exploded view of a preferred embodiment of the present invention.
Figure 2:
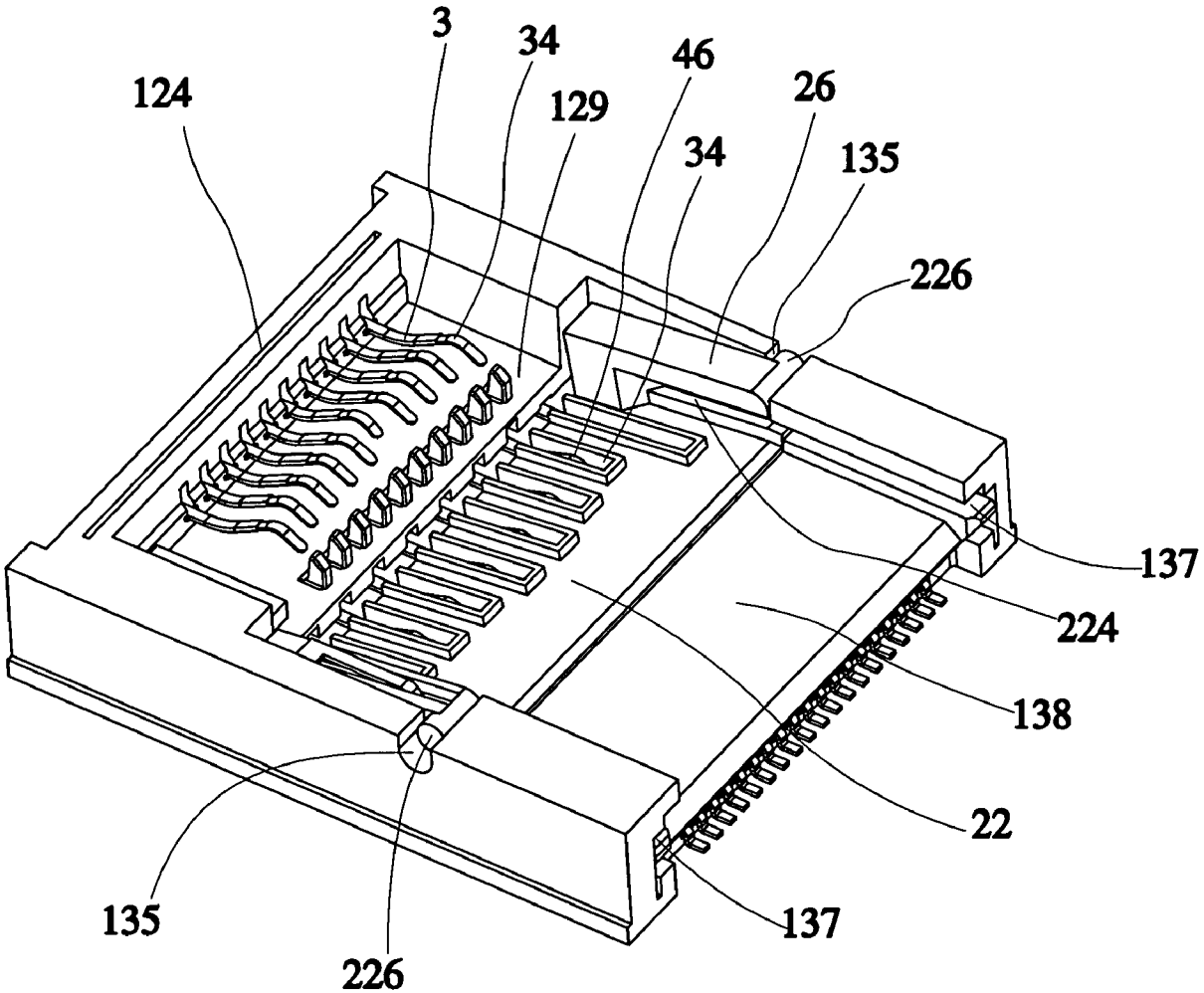
FIG. 2 is a perspective view of the first preferred embodiment of the present invention which cover shell is removed therefrom.
Figure 3:
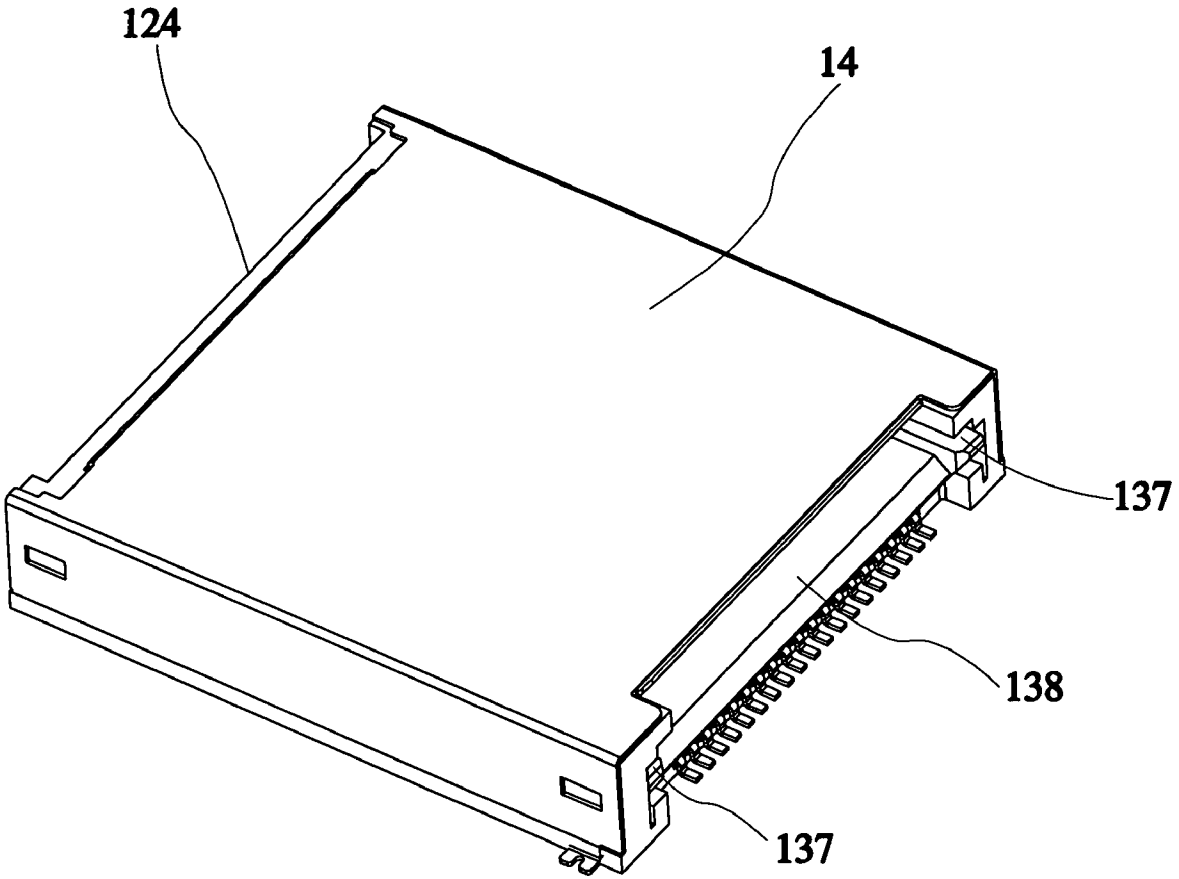
FIG. 3 is a perspective view of the preferred embodiment of the present invention.
Figure 4:
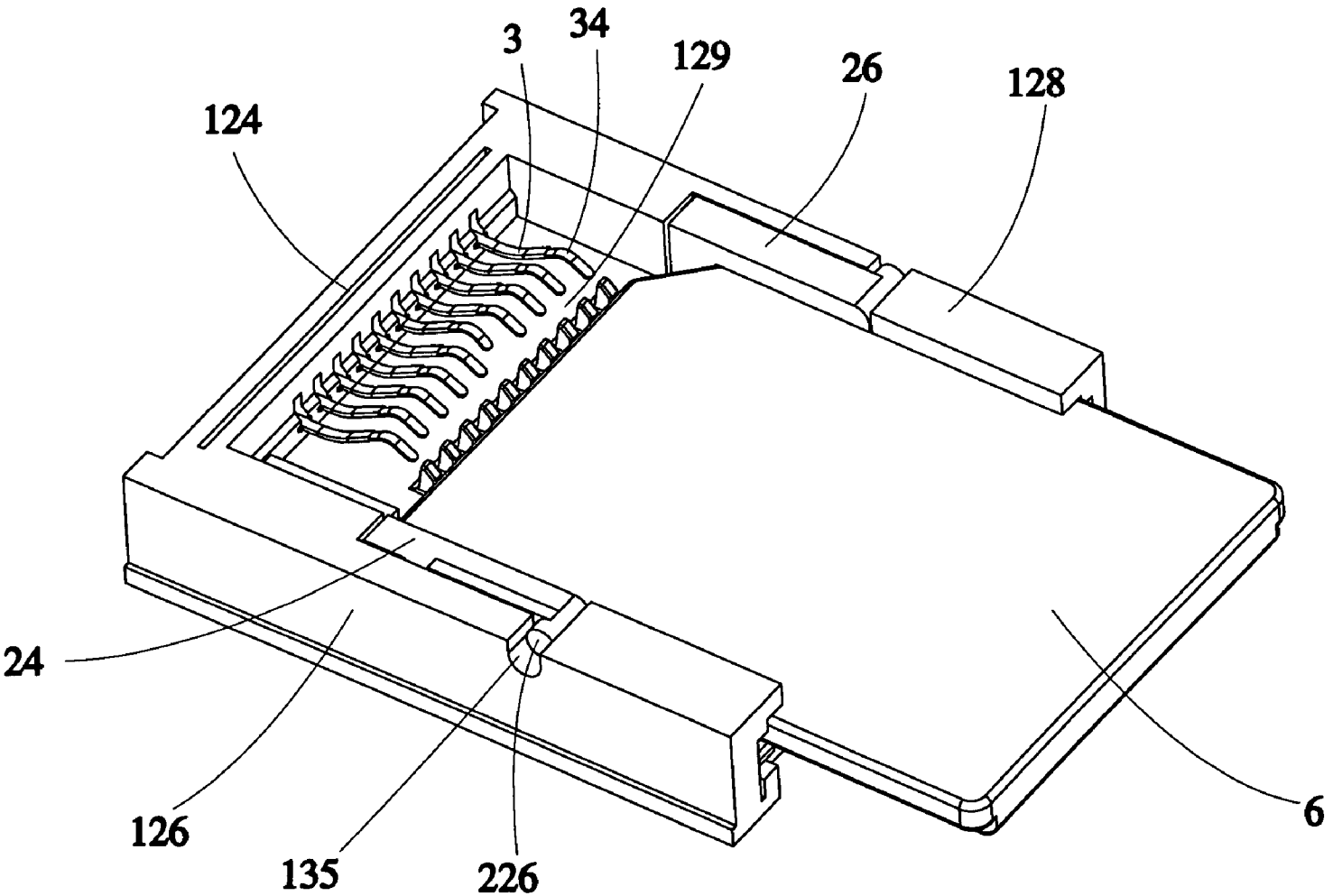
FIG. 4 is similar to FIG. 2, illustrating that an SD card is inserted into the card connector.
Figure 5:
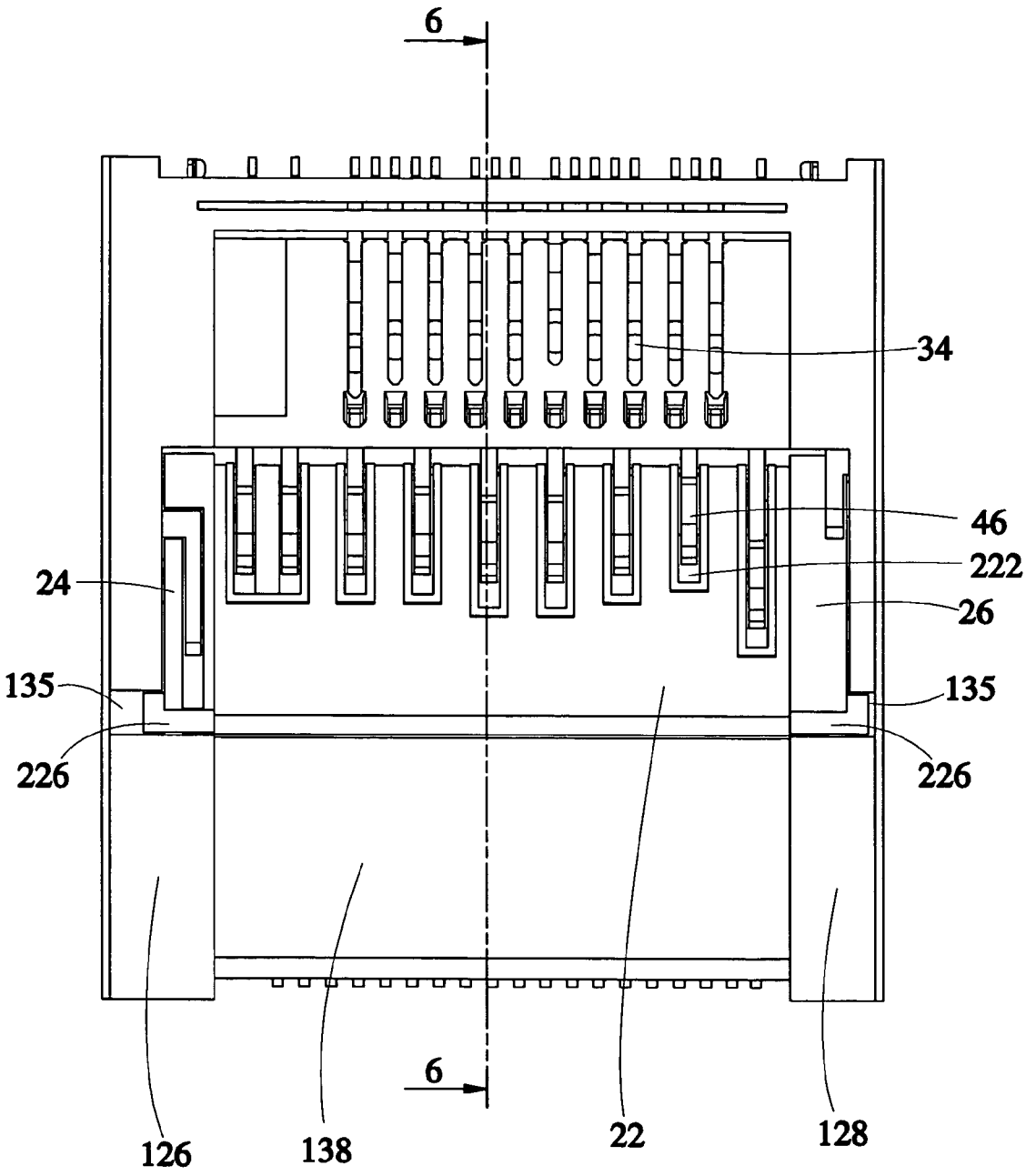
FIG. 5 is a top view of FIG. 2.
Figure 6:
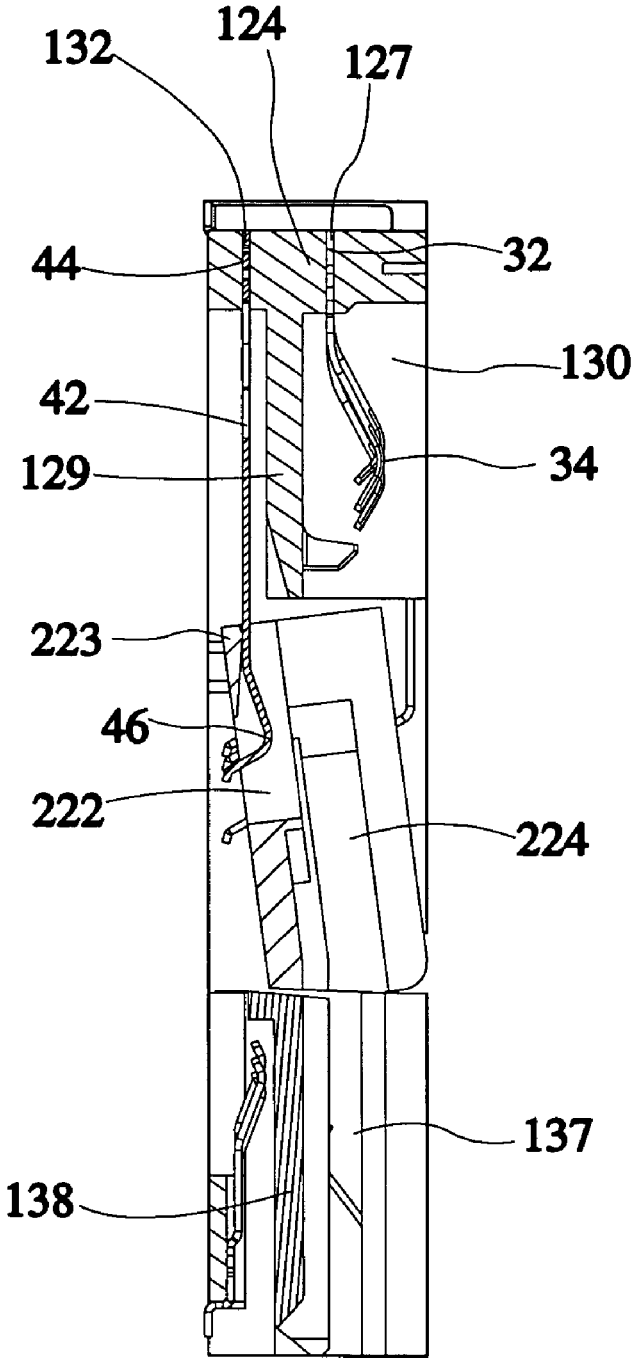
FIG. 6 is a cross-sectional view taken along a line 6-6 taken in FIG. 5.
Figure 7:
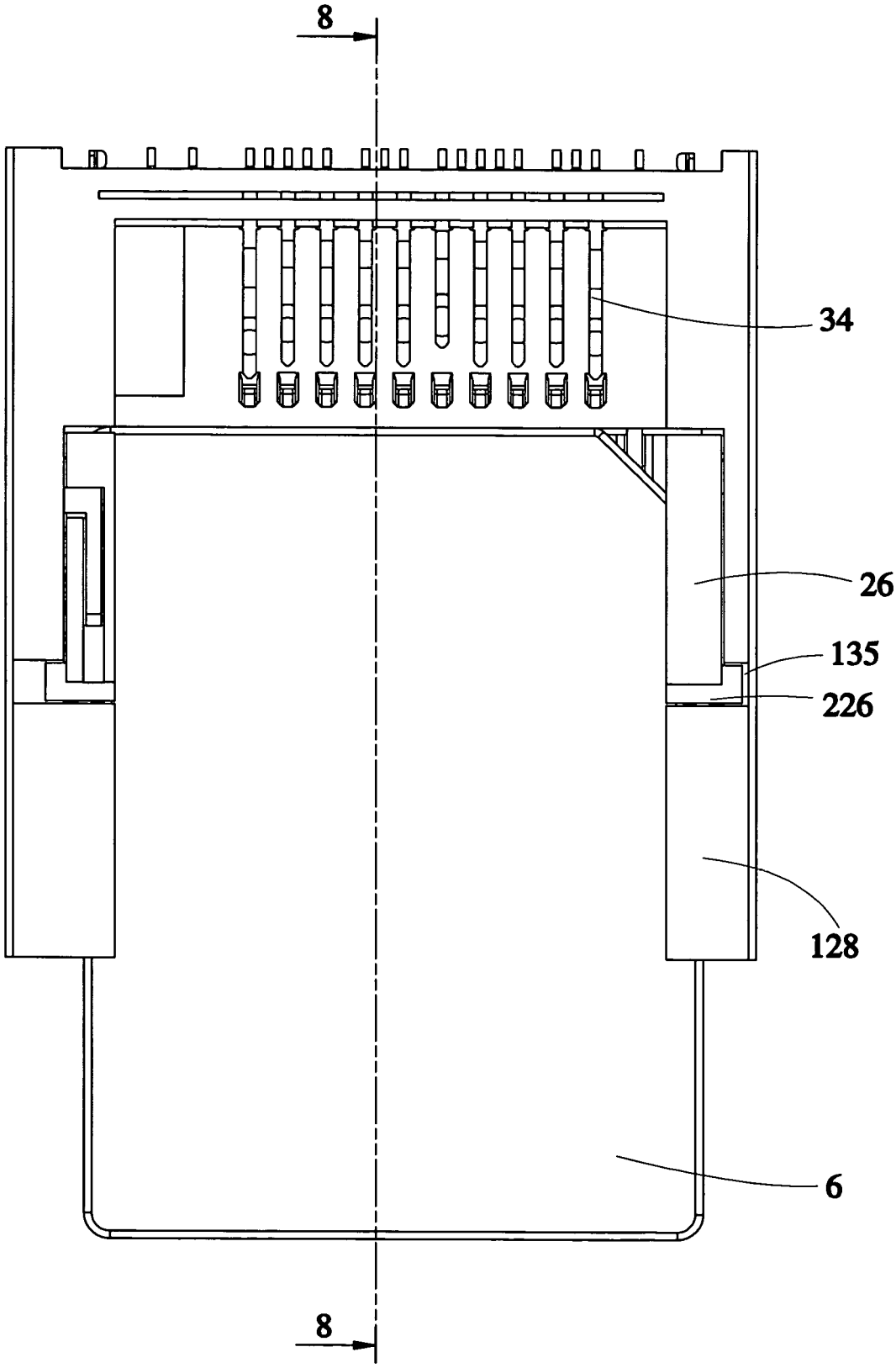
FIG. 7 is a top view of the preferred embodiment of the present invention, which cover shell is removed therefrom and in which the SD card is inserted.
Figure 8:
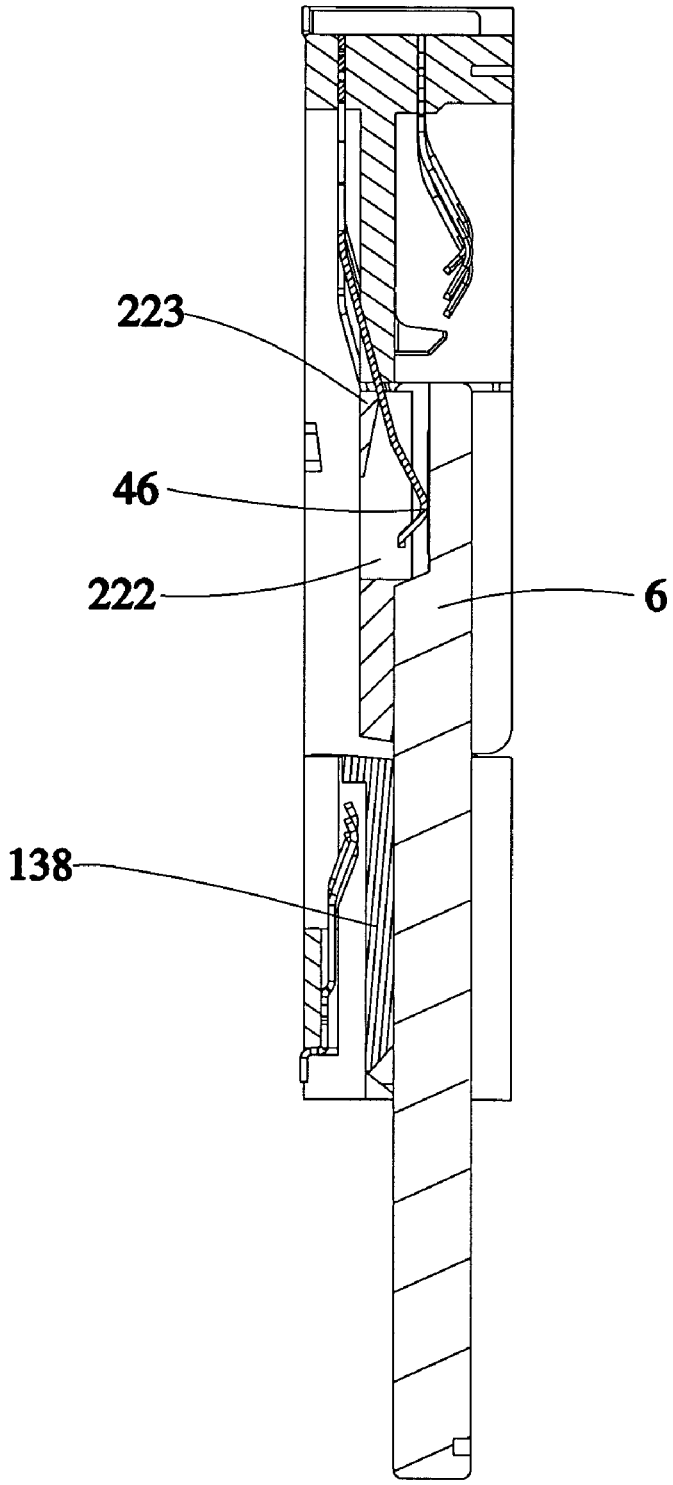
FIG. 8 is a cross-sectional view taken along a line 8-8 indicated in FIG. 7.
Figure 9:
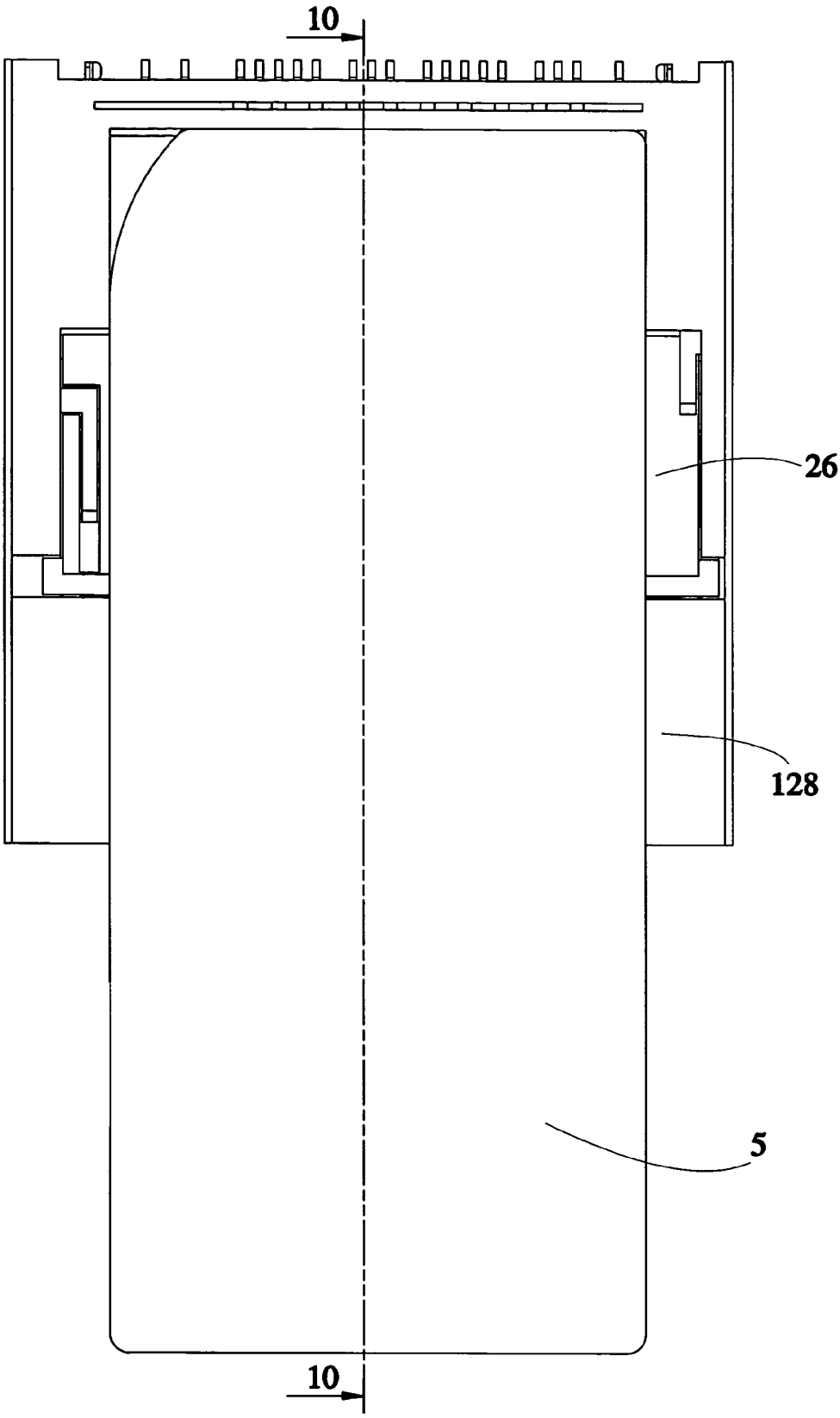
FIG. 9 is a top view of the preferred embodiment of the present invention, which cover shell is removed therefrom and in which an MC card is inserted.
Figure 10:
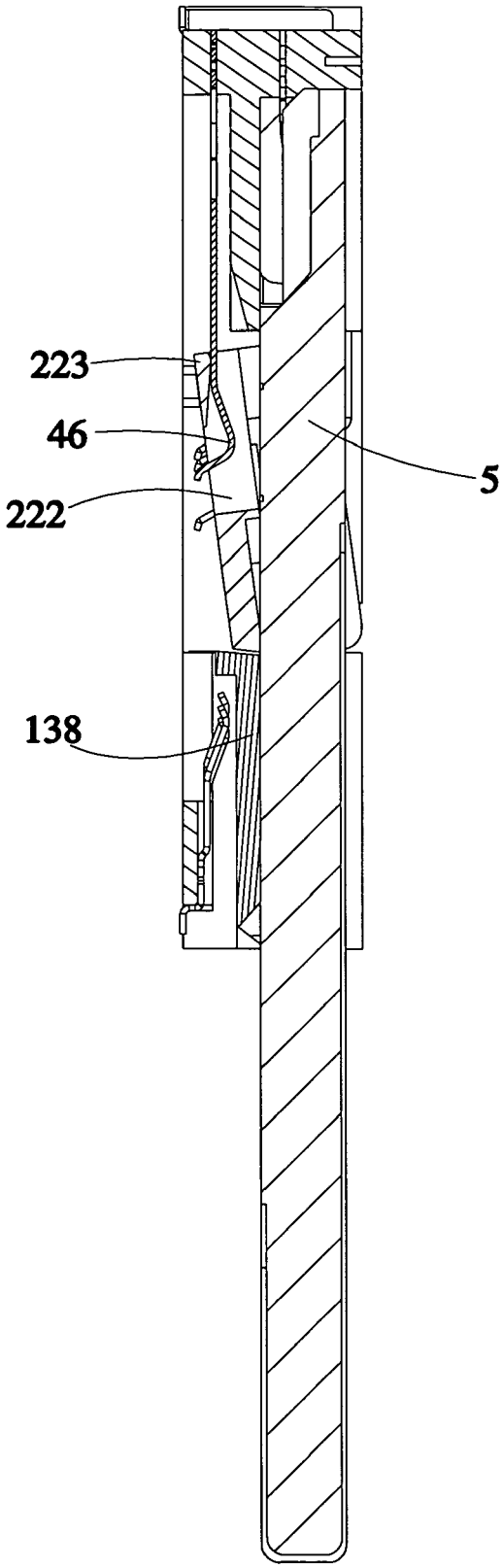
FIG. 10 is a cross-sectional view taken along a line 10-10 indicated in FIG. 9.

Referring to FIGS. 1-10, a terminal-protective card connector constructed according to a preferred embodiment of the present invention is composed of a housing 1, a pivoting device 2, a group of first terminals 3, and a group of second terminals 4.

The housing 1 includes a base 12 and a cover shell 14. The base 12 has a rear sidewall 124, a left sidewall 126, a right sidewall 128, and a rear platform 129 protruding vertically forward from a midsection of the rear sidewall 124. A plurality of first insertion slots 127 are formed on the rear sidewall 124 and above the rear platform 129 and arranged in parallel. A first card receiving chamber 130 is defined by the left and right sidewalls 126 and 128 and the rear platform 129. A plurality of second insertion slots 132 are formed on the rear sidewall 124 and below the rear platform 129 and arranged in parallel. A front platform 138 is formed between front ends of the left and right sidewalls 126 and 128 and located as high as the rear platform 129. An opening 139 is formed between the front and rear platforms 138 and 129. Two slide grooves 137 corresponding to SD and MMC cards in thickness are formed at bilateral sides of the front platform 138 respectively and located close to the left and right sidewalls 126 and 128 respectively. A recess 135 is formed on each of the left and right sidewalls 126 and 128, adjacent to the front platform 138.

The cover shell 14 is a metallic plate formed by its two ends punched vertically downward, covered on the base 12.

The pivoting device 2 is a pivotable plate, including a plate member 22 having a left plate 24 and a right plate 26 vertically located at a left fringe thereof and a right fringe thereof respectively. The plate member 22 has a plurality of terminal receiving slots 222 formed on a top surface thereof and arranged in parallel, and a plurality of pushing portions 223 formed thereon and mounted to the terminal receiving slots 222. The left and right plates 24 and 26 each have a slide channel 224 formed at an inner sidewall thereof and corresponding to each of the slide grooves 137 of the left and right sidewalls 126 and 128. Each of the left and right plates 24 and 26 has a lug 226 protruding outward from a front end thereof. The two lugs 226 are mounted to the recesses 135 of the left and right sidewalls 126 and 128.

Each of the first terminals 3 includes a root portion 32 and an arched contact portion 34 extending from a front end of the root portion 32. The root portions 32 are fixedly inserted in the first insertion slots 127. The contact portions 34 extend into the first card receiving chamber 130, located close to an inner side of the card connector. Thus, the first terminals 3 are adapted for electrical connection with a narrow and thick MS card 5.

Each of the second terminals 4 includes a main body 42, a root portion 44 extending from a rear end of the main body 42, and an arched contact potion 44 extending from a rear end thereof from a front end of the main body 42 and bending upward. The root portions 44 are fixedly inserted in the second insertion slots 132. The main bodies 42 are mounted under the rear platform 129. The contact portions 46 are corresponsively mounted to the terminal receiving slots 222. Because of the resilience, the second terminals 4 presses the pivoting device 2 downward to drive the plate member 22 to incline downward for a given angle. The contact portions 46 of the second terminals 4 are mounted close to an entrance of the card connector, such that the second terminals 4 can be electrically connected with the relatively wide and thin SD card 6 and the MMC card (show shown).

While the above elements are being installed into the card connector, the first terminals 3 are installed to the first insertion slots 127 respectively and then the second terminals 4 are installed to the second insertion slots 132; the pivoting device 2 is mounted to the base 12, the two lugs 226 are installed into the recesses 135 of the left and right sidewalls 126 and 128, whereby the plate member 22 is pivotable at the opening 139; the contact portions 46 of the second terminals 4 are corresponsively installed into the terminal receiving slots 222 of the pivoting device 2; meanwhile, the second terminals 4 lie on the pushing portions 223 to enable the contact portions 46 to be located lower than the rear platform 129; and finally, the cover shell 14 is installed on the base 12.

While the short and wide SD card 6 is inserted, the SD card 6 is inserted along the slide grooves 137 of the left and right sidewalls 126 and 128 and then enters the slide channels 224 of the left and right plates 24 and 26 to pull the plate member 22 upward. While the plate member 22 is pulled upward to pivot upward, the pushing portions 223 are moved upward to contact against lower sides of the main bodies 42 of the second terminals 4. Thus, the contact portions 46 are also corresponsively moved upward to be higher than the front platform 138 until the plate member 22 is located on the same plane as the front platform 138. After the card 6 continues to be inserted into a final position, contact pins (not shown) mounted to the SD card 6 are electrically connected with the contact portions 46 of the second terminals 4 for conduction.

Because of the resilience, the second terminals 4 press the pivoting device 2 downward to drive the plate member 22 to incline downward for a given angle. While the narrow and thick MS card 5 is inserted, the card 5 is too thick and narrow to enter the slide grooves and channels 137 and 224. After the MS card 5 continues to be inserted into a final position, contact pins (not shown) mounted on the MS card 5 are electrically connected with the first terminals 3 for conduction without contact with the second terminals 4.

Because the slide grooves 137 and the slide channels 224, while inserted into the card connector, the short and wide SD card 6 passes through the slide grooves and channels 137 and 224 to pull the pivoting device 22 upward to enable the contact portions 46 of the second terminals 4 for contact with the contact pins of the SD card 6 for electric conduction; while inserted into the card connector, the long and narrow MS card 5 passes over the second terminals 4 to contact the first terminals 3 for electrical conduction without contact with the second terminals 4. In light of this, the present invention achieves that one card connector can receive multiple kinds of electronic cards and effectively prevent each inserted card (the MS card 5) corresponding to the first terminals 3 from crashing into the second terminals 4 to keep the terminals of the card connector safe.

Although the present invention has been described with respect to a specific preferred embodiment thereof, it is no way limited to the details of the illustrated structures but changes and modifications may be made within the scope of the appended claims.

What is claimed is:

1. A terminal-protective card connector comprising:

a housing having a base, said base having a rear sidewall, a left sidewall, a right sidewall, and a rear platform protruding forward from a midsection of said rear sidewall, each of said left and right sidewalls having a slide groove formed at an inner side thereof;

a group of first terminals and a group of second terminals, each of said first and second terminals having a root portion and a contact portion, said root portions being fixedly inserted above and below said rear platform; and a pivoting device pivotably mounted between said left and right sidewalls and having a plate member, a plurality of pushing portions formed on said plate member, a left plate formed at a left fringe of said plate member, a right plate formed at a right fringe of said plate member, and two slide channels formed at inner sides of said left and right plates and corresponding to said slide grooves respectively;

wherein said contact portions of said second terminals are mounted on a top surface of said plate member, and said second terminals lie on said pushing portions to enable the contact portions of said second terminals to be lower than said rear platform.

2. The card connector as defined in claim 1, wherein said housing further comprises a cover shell, said cover shell being formed by its two ends punched vertically downward and covered on said base.

3. The card connector as defined in claim 1, wherein said housing further comprises a front platform formed between front ends of said left and right sidewalls and located as high as said rear platform.

4. The card connector as defined in claim 1, wherein each of said slide grooves corresponds to an SD card and an MMC card in thickness.

5. The card connector as defined in claim 1, wherein each of said left and right sidewalls comprises a recess formed thereon; each of said left and right plates comprises a lug protruding outward from a front end thereof, said two lugs being mounted to said two recesses respectively to enable said pivoting device to be pivotably mounted between said left and right sidewalls.

6. The card connector as defined in claim 1, wherein said plate member further comprises a plurality of terminal receiving slots formed on a top surface thereof, said pushing portions are mounted to said terminal receiving slots respectively; said contact portions of said second terminals are mounted to said terminal receiving slots.

7. The card connector as defined in claim 1, wherein said first terminals are adapted for electrical connection with an MS card.

8. The card connector as defined in claim 1, wherein said second terminals are adapted for electrical connection with an SD/MMC card.

9. The card connector as defined in claim 1, wherein said rear sidewall further comprises a plurality of first insertion slots and second insertion slots formed above and below said rear platform respectively; said root portions of said first and second terminals are fixedly inserted into said first and second insertion slots respectively.

* * * * *